US006656880B2

(12) United States Patent
Aono

(10) Patent No.: US 6,656,880 B2
(45) Date of Patent: Dec. 2, 2003

(54) HEAT-SENSITIVE RECORDING MATERIAL

(75) Inventor: Toshiaki Aono, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/947,440

(22) Filed: Sep. 7, 2001

(65) Prior Publication Data

US 2002/0058590 A1 May 16, 2002

(30) Foreign Application Priority Data

Sep. 8, 2000 (JP) ..... 2000-273635

(51) Int. Cl.[7] ..... B41M 5/40
(52) U.S. Cl. ..... 503/207; 503/226; 503/200
(58) Field of Search ..... 428/195, 207; 503/200, 226

(56) References Cited

FOREIGN PATENT DOCUMENTS

| | | |
|---|---|---|
| JP | 60-124287 | 7/1985 |
| JP | 2-47088 | 2/1990 |

*Primary Examiner*—B. Hamilton Hess
(74) *Attorney, Agent, or Firm*—Sughrue Mion, PLLC

(57) ABSTRACT

A heat-sensitive recording material having a heat-sensitive recording layer on a substrate. An outermost layer from the substrate contains microparticle-aggregation particles. The microparticle-aggregation particles are preferably formed by silica microparticles, and the outermost layer is preferably a protective layer. The microparticle-aggregation particles have hardness such that soiling of a thermographic printing head is low, and softness such that wear of the thermographic printing head is low.

16 Claims, No Drawings

HEAT-SENSITIVE RECORDING MATERIAL

BACKGROUND OF THE INVENTION

1. Field of the Invention

The present invention relates to a heat-sensitive recording material having a heat-sensitive recording layer on a substrate, and more particularly to a heat-sensitive recording material suitable for recording using a heating element such as a thermal head or the like.

2. Description of Related Art

In recent years, heat-sensitive recording has rapidly grown in popularity, because of benefits such as: 1) no need for development; 2) when paper is used as a substrate, the recording material is very similar to ordinary paper; 3) easy handling; 4) high color density; 5) simple and inexpensive recording devices; 6) no noise during recording; 7) high reliability, meaning low maintenance; and the like.

Against this background, there has also been rapid progress in the shift to color imaging, and demand is high for multi-color heat-sensitive recording materials that can be directly recorded with thermal heads and the like.

In heat-sensitive recording, a recording surface of a heat-sensitive recording material is directly contacted by a heating element such as a thermal head or the like. In this state, heat is generated and the heating causes color development. The heating element is switched between on and off states and an image is thereby recorded. Accordingly, if runnability (transportability) of the recording material during recording is to be improved, or if adhesion of dirt to a surface of the thermal head must be avoided, microparticles, which are inorganic particles or the like, are generally provided at an outermost layer of the recording material, which contacts the thermal head.

However, in order to avoid a reduction in not only heat transmission to the recording material during recording but also image quality, which depends on heat transmitted, a certain amount of contact pressure is applied and the head is pressed against the recording material. As a result, wearing tends to occur. In particular, if there are many high-hardness inorganic particles at the surface of the outermost layer, wearing of the thermal head (head-wearing) is rapid, and durability thereof is greatly reduced. Wearing of the thermal head is particularly noticeable in cases where application of heat is performed at a high temperature to obtain high color density and where heat is applied continuously for multi-color recording.

Wear can be moderated and the durability of the head improved by techniques that reduce the above-described head-wearing. These techniques include reducing contact pressure, and making the surface with which the head contacts softer by using microparticles with a comparatively low hardness or the like. However, these techniques tend to increase amounts of dirt at the thermal head (head-soiling). Head-soiling inhibits the transfer of heat to the recording material, and interferes with homogeneous color formation. Therefore, in order to obtain sharp images with homogeneous density, it is desirable that head-soiling tends not to occur.

Accordingly, head-wearing and head-soiling have a reciprocal relationship, such that when one is improved, the other tends to deteriorate. Until now it has proved difficult to improve both at the same time.

In accordance with the foregoing, a heat-sensitive recording material that can record, stably over long periods, sharp images with excellently homogeneous density, that alleviates head-wearing and does not reduce durability, and that does not lead to a loss of image quality due to head-soiling has been desired.

SUMMARY OF THE INVENTION

The present invention is provided to solve the above-described various problems of the conventional art, and the goal of the present invention is to achieve the following object.

An object of the present invention is to provide a heat-sensitive recording material that is capable of stably recording sharp images with excellently homogeneous density and suppressing head-wearing without causing loss of image quality due to head-soiling.

The inventor of the present invention has performed assiduous investigations into effects of recording surfaces on thermal heads. The inventor has combined results thereof and has discovered that, while the presence of microparticles at the surface contacting the head is essential for runnability, it is necessary that the microparticles have hardness such that head-soiling does not occur and softness (pressure absorbence) such that the head is not scratched.

The present invention is a heat-sensitive recording material having a heat-sensitive recording layer on a substrate, wherein an outermost layer from the substrate contains microparticle-aggregation particles.

DETAILED DESCRIPTION OF THE PREFERRED EMBODIMENTS

A heat-sensitive recording material of the present invention includes microparticle-aggregation particles in an outermost layer, which contacts with a heating element such as a thermal head or the like during recording.

The heat-sensitive recording material of the present invention is described in detail below.

The heat-sensitive recording material of the present invention has, on a substrate, at least a heat-sensitive recording layer. The heat-sensitive recording material preferably also has a protective layer. The heat-sensitive recording material has other layers, such as an intermediate layer and the like, as necessary.

The present invention includes microparticle-aggregation particles in the outermost layer provided on the substrate, that is, the layer disposed furthest from the substrate (which may be a heat-sensitive recording layer or a protective layer). Further, the heat-sensitive recording layer may be a single-color heat-sensitive recording layer formed by a single layer, or may be a multi-color heat-sensitive recording layer in which a plurality of single-color heat-sensitive recording layers that develop mutually different hues are stacked.

Microparticle-Aggregation Particles

The microparticle-aggregation particles are regular or irregular particle aggregations formed by aggregating pluralities of microparticles. More fundamentally, a microparticle-aggregation particle may be a particle in which some microparticles have been mutually chemically bonded (e.g., by siloxane bonds or the like). Alternatively, the microparticle-aggregation particle may be a particle in which some microparticles have been attracted together by interaction forces between individual microparticles or the like, cohered and aggregated, and held together to form a single particle.

The microparticle-aggregation particles also include particles in which pluralities of microparticles have been made into microparticle aggregations by a binder having elasticity and softness, to thereby provide aggregation particles provided with sufficient softness to be pressure-deformable, as described below.

Because the present invention contains the microparticle-aggregation particles (occasionally hereafter referred to as "aggregation particles") in the outermost layer, which contacts with the thermal head, it is possible for a surface of the outermost layer to have particles that are provided with a certain degree of hardness and with a softness sufficient to allow pressure-deformation when pressure is applied. That is, the particles have sufficient hardness to prevent head-soiling during recording, but do not have sufficient hardness to scratch and wear the head when a pressing force at or exceeding a certain level is applied at the head. Therefore, head-soiling can be avoided, while at the same time wear of the thermal head can be reduced, even in cases of continuous high-density recording, multi-color recording and the like, and thus durability of the head can be greatly improved.

As described earlier, in order to obtain the effects of preventing both head-soiling and head-wearing, it is essential that the microparticle-aggregation particles are present across the whole of the surface of the outermost layer. Specifically, a total surface coverage of the microparticle-aggregation particles is preferably 20 to 90%, and more preferably 30 to 70%.

Consequently, microparticle-aggregation particles relating to the present invention do not include aggregates that are effectively only partially or locally present in a layer, such as in cases where a layer is formed to include aggregations caused by, for example, a coating liquid lacking dispersion stability or particles cohering to each other during coating or the like, and the like. That is, even if such aggregations were present in the head-contacting outermost layer, because the aggregations would only be partially or locally present in the layer, effects of long-term protection of the thermal head from soiling and of suppression of wear could not be sufficiently provided.

In the above, a hardness sufficient for suppressing head-soiling is dependent on the hardness of the microparticles structuring the aggregation particles, and a hardness so as to scratch and wear the head is dependent on the hardness of the aggregation particles themselves. Consequently, simply providing particles in the outermost layer, which the head contacts, could not achieve the effects of the present invention. However, it is effective to have in the outermost layer an aggregate in which pluralities of particles having sufficient hardness to prevent soiling are cohered and aggregated by interactions therebetween, such that the individual particles do not solidify with each other but deform when pressure is applied, so that frictional pressure at the head is alleviated.

In view of the above, provided the microparticle-aggregation particles are included in the outermost layer on the substrate, the microparticle-aggregation particles may be provided in any of a heat-sensitive recording layer, a protective layer and the like. Of these, if the substrate has both a heat-sensitive recording layer and a protective layer thereon, the microparticle-aggregation particles are preferably included in the protective layer.

The hardness (Mohs' hardness) of the microparticle-aggregation particles is preferably from 2 to 8, and more preferably from 3 to 7. If the hardness is less than 2, it may not be possible to prevent head-soiling. If the hardness is more than 8, it will be possible to prevent head-soiling but it may not be possible to prevent head-wearing.

The shapes of the microparticle-aggregation particles may be any shape, regular or irregular, selected as appropriate. With regard to effectiveness, aggregation particles formed in a substantially spherical shape are preferable. Further, the microparticle-aggregation particles include aggregations composed of at least 10 microparticles, and preferably 100 to 1,000,000 microparticles.

Moreover, the microparticle-aggregation particles are preferably composed of microparticles with a particle size of 0.5 $\mu$m or less, more preferably composed of microparticles with a particle size of 0.2 $\mu$m or less, and most preferably composed of microparticles with a particle size of 0.1 $\mu$m or less. If the particle size is more than 0.5 $\mu$m, smoothness of the surface will be reduced, and it may be easy for the particles to detach from the layer surface.

The microparticle-aggregation particles may be either aggregation particles composed of inorganic microparticles or aggregation particles composed of organic microparticles. With regard to the individual microparticles being hard enough to effectively avoid head-soiling, aggregation particles composed of inorganic microparticles are preferable.

Examples of the aggregation particles composed of inorganic microparticles include aggregation particles composed of microparticles such as ultra-fine grain silica, barium sulfate, alumina and the like. Examples of marketed products include SILICA MICROBEAD P500 (manufactured by Catalyst & Chemicals Ind. Co. Ltd.); MIZUKASIL P705, P707, P527, P801, etc. (manufactured by Mizusawa Chemical Co., Ltd.); AEROSIL TT600, OX50, etc. (manufactured by Nippon Aerosil Co., Ltd.); and the like.

Examples of the aggregation particles composed of organic microparticles include aggregation particles composed of microparticles such as urea resin microparticles, benzoguanamine resin particles and the like. Examples of marketed products include ORGANIC FILLER (manufactured by Nippon Kasei Chemical Co., Ltd.) and the like.

Of these, aggregation particles composed of ultra-fine grain silica, particularly ultra-fine grain silica with a mean particle size of 10 to 100 nm (more preferably 10 to 50 nm), are preferable. Furthermore, the particles are preferably substantially spherical. The aforementioned SILICA MICROBEAD P500 (manufactured by Catalyst & Chemicals Ind. Co. Ltd.) is particularly preferable.

The microparticle-aggregation particles may contain a single type of microparticle or a combination of two or more types.

The mean particle size of the microparticle-aggregation particles, that is, the mean largest dimension thereof, is preferably 0.5 to 10 $\mu$m, more preferably 1 to 7 $\mu$m, further preferably 1.5 to 5 $\mu$m, and most preferably 2 to 3 $\mu$m.

If the mean particle size is less than 0.5 $\mu$m, head-soiling may occur. If the mean particle size is more than 10 $\mu$m, it will be easy for the microparticle-aggregation particles to detach from the layer surface, and detached microparticle-aggregation particles may adhere to or accumulate on the head, and cause damage to a print surface.

In cases where glossiness is required, it is preferable to use aggregation particles having a mean particle size toward the large end of the full range (a mean particle size of 1 to 3 $\mu$).

The mean particle size of the microparticles that structure the microparticle-aggregation particles and aggregation particles can be measured accurately using electron microscopy, but can be measured more easily using laser scattering.

In order to avoid both head-soiling and head-wearing as described above, the microparticle-aggregation particles should be contained in a range as follows.

An amount of the microparticle-aggregation particles present in the outermost layer of the heat-sensitive recording material is preferably 0.01 to 1.0 g/m$^2$, and more preferably 0.05 to 0.5 g/m$^2$. If the amount present is less than 0.01 g/m$^2$, it may not be possible to avoid both head-soiling and head-wearing. If the amount present is more than 1.0 g/m$^2$, sensitivity may be reduced and head-wearing may be unexpectedly worsened rather than improved.

By including the microparticle-aggregation particles in the outermost layer as described above, head-soiling can be avoided, at the same time wear of the thermal head can be reduced, and durability of the thermal head can be greatly improved.

Next, details are given of each of the layers that structure the heat-sensitive recording material of the present invention.

Heat-Sensitive Recording Layer

The heat-sensitive recording layer has at least a color-forming component. The heat-sensitive recording layer may be a single-layer single-color heat-sensitive recording layer, or may be a multi-color heat-sensitive recording layer in which a plurality of single-color heat-sensitive recording layers that form mutually different hues are stacked. If a heat-sensitive recording layer forms the outermost layer and is composed of a plurality of layers, the microparticle-aggregation particles are contained only in the outermost layer thereof.

Further, the heat-sensitive recording layer includes other components as necessary, such as a basic material, a sensitizer and the like.

Color-Forming Component and the Like

The color-forming component may be a two-component color source (a color-forming component and a compound that causes color formation), such as in combination examples (a) to (r) following. (In each of these examples, the first component given is the color-forming component and the second is the compound that causes color formation.)

(a) A combination of a photodecomposable diazonium salt compound and a coupling component (below referred to as a "coupler" where appropriate).

(b) A combination of an electron-donating dye precursor and an electron-accepting compound.

(c) A combination of a metal salt of an organic acid, such as silver behenate, silver stearate or the like, and a reducing agent, such as protocatechuic acid, spiroindane, hydroquinone or the like.

(d) A combination of an iron salt of a long-chain fatty acid, such as ferric stearate, ferric myristate or the like, and a phenol, such as tannic acid, gallic acid, ammonium salicylate or the like.

(e) A combination of a heavy metal salt of an organic acid, such as a nickel, cobalt, lead, copper, iron, mercury or silver salt of acetic acid, stearic acid, palmitic acid or the like, and a sulfide of an alkali metal or alkaline earth metal, such as calcium sulfide, strontium sulfide, potassium sulfide or the like; or a combination of a heavy metal salt of an organic acid as described above and an organic chelating agent, such as s-diphenyl carbazide, diphenyl carbazone or the like.

(f) A combination of a heavy metal sulfate, such as a sulfate of silver, lead, mercury, sodium or the like, and a sulfur compound, such as sodium tetrathionate, sodium thiosulfate, thiourea or the like.

(g) A combination of an aliphatic ferric salt, such as ferric stearate or the like, and an aromatic polyhydroxy compound, such as tetrakis (3,4-dihydroxyphenyl) methane or the like.

(h) A combination of a metal salt of an organic acid, such as silver oxalate, mercury oxalate or the like, and an organic polyhydroxy compound, such as polyhydroxy alcohol, glycerin, glycol or the like.

(i) A combination of a ferric salt of a fatty acid, such as ferric pelargonate, ferric laurate or the like, and a thiocetyl carbamide or isothiocetyl carbamide derivative.

(j) A combination of a lead salt of an organic acid, such as lead caproate, lead pelargonate, lead behenate or the like, and a thiourea derivative, such as ethylene thiourea, N-dodecyl thiourea or the like.

(k) A combination of a heavy metal salt of a higher fatty acid, such as ferric stearate, copper stearate or the like, and zinc dialkyldithiocarbamate.

(l) A combination that forms an oxazine dye, such as a combination of resorcin and a nitroso compound.

(m) A combination of a formazan compound and a reducing agent and/or metal salt.

(n) A combination of a protected dyestuff (or leuco dyestuff) precursor and a protection-removing agent.

(o) A combination of an oxidation-type color-forming agent and an oxidizer.

(p) A combination of a phthalonitrile and a diiminoisoindoline (a combination that generates phthalocyanine).

(q) A combination of an isocyanate and a diiminoisoindoline (a combination that generates a color pigment).

(r) A combination of a pigment precursor and an acid or a base (a combination that forms a pigment).

Of these, (a) the combination of a photodecomposable diazonium salt compound and a coupler, (b) the combination of an electron-donating dye precursor and an electron-accepting compound, and (c) the combination of an organometallic salt and a reducing agent are preferable in the present invention. Of these, the combinations of (a) and (b) are more preferable, and the combination of (a) is most preferable.

The same applies when the present invention is applied to a full-color heat-sensitive recording material.

The heat-sensitive recording layer of the heat-sensitive recording material of the present invention can have various structural forms. However, it is preferable that on the substrate there is at least one layer that is a light-fixing-type heat-sensitive recording layer, which includes as main components a diazonium salt compound and a coupler that performs a coupling reaction with the diazonium salt compound. In the case of a multi-color recording material, it is desirable to have heat-sensitive recording layers formed with diazo-type color-forming components for each of cyan, yellow and magenta. Moreover, a protective layer may, as necessary, be provided on the heat-sensitive recording layers at an irradiated light-incidence side, so as to be the outermost layer. Further, as described earlier, intermediate layers may, as appropriate, be provided between respective recording layers in a heat-sensitive recording layer with a multi-layer configuration. Specific structural forms are described below.

Examples of other compounds that may be used in a heat-sensitive recording layer that contains a diazonium salt compound and a coupler include a basic material, which accelerates the reaction between the diazonium salt compound and the coupler, a sensitizer, and the like.

The diazonium salt compound is a compound represented by formula (I) below. The wavelength of maximum absorption of the compound can be controlled on the basis of position and type of a substituent at the Ar section.

$$Ar—N_2^+.X^- \quad (I)$$

(In the formula, Ar represents an aryl group and $X^-$ represents an acid anion.)

Examples of the diazonium salt compound include acid anion salts such as 4-(N-(2-(2,4-di-tert-amylphenoxy)butyryl)piperazino) benzene diazonium,
4-dioctylaminobenzene diazonium,
4-(N-(2-ethyl hexanoyl)piperazino)benzene diazonium,
4-dihexylamino-2-hexyloxybenzene diazonium,
4-N-ethyl-N-hexadecylamino-2-ethoxybenzo diazonium,
3-chloro-4-dioctylamino-2-octyloxybenzene diazonium,
2,5-dibutoxy-4-morpholinobenzene diazonium,
2,5-dioctoxy-4-morpholinobenzene diazonium,
2,5-dibutoxy-4-(N-(2-ethylhexanoyl)piperazino)benzene diazonium,
2-5-diethoxy-4-(N-(2-(2,4-di-tert-amylphenoxy)butyryl) piperazino)benzene diazonium,
2-5-dibutoxy-4-tolylthiobenzene diazonium,
3-(2-octyloxyethoxy)-4-morpholinobenzene diazonium and the like, and the diazonium salt compounds shown below (illustrative compounds D-1 to D-5).

Further, hexafluorophosphate salts, tetrafluoroborate salts, and 1,5-naphthalene sulfonate salts may be suitably used.

D-1

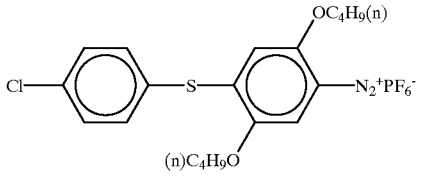

D-2

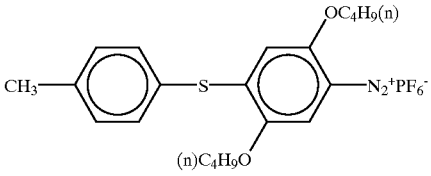

D-3

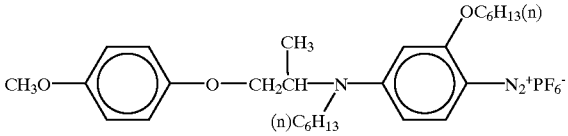

D-4

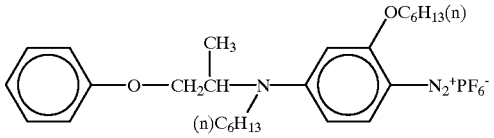

-continued

D-5

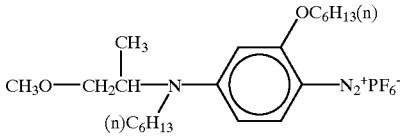

Of these, preferable compounds, which are photodecomposable by light at wavelengths of 300 to 400 nm, are 4-(N-(2-(2,4-di-tert-amylphenoxy)butyryl)piperazino) benzene diazonium,
4-dioctylaminobenzene diazonium,
4-(N-(2-ethylhexanoyl)piperazino)benzene diazonium,
4-dihexylamino-2-hexyloxybenzene diazonium,
4-N-ethyl-N-hexadecylamino-2-ethoxybenzo diazonium,
2,5-dibutoxy-4-(N-(2-ethylhexanoyl)piperazino)benzene diazonium,
2,5-diethoxy-4-(N-(2-(2,4-di-tert-amylphenoxy)butyryl) piperazino)benzene diazonium and the compounds shown as illustrative compounds D-3 to D-5.

The wavelengths of maximum absorption of the diazonium salt compounds mentioned here were measured for each compound with a spectrophotometer (Shimazu MPS-2000) for a film of 0.1 to 1.0 g/m$^2$.

Examples of the coupler for colorizing that reacts with the diazonium salt compound when heated include resorcin, phloroglucin,
sodium 2,3-dihydroxynaphthalene-6 sulfonate,
1-hydroxy-2-naphthoic acid morpholinopropyl amide,
1,5-dihydroxynaphthalene,
2,3-dihydroxynaphthalene,
2,3-dihydroxy-6-sulfanylnaphthalene,
2-hydroxy-3-naphthoic acid anilide,
2-hydroxy-3-naphthoic acid ethanol amide,
2-hydroxy-3-naphthoic acid octyl amide,
2-hydroxy-3-naphthoic acid-N-dodecyloxy propyl amide,
2-hydroxy-3-naphthoic acid tetradecyl amide, acetanilide, acetoacetanilide, benzoylacetanilide,
2-chloro-5-octylacetoacetanilide,
1-phenyl-3-methyl-5-pyrazolone,
1-(2'-octylphenyl)-3-methyl-5-pyrazolone,
1-(2',4',6'-trichlorophenyl)-3-benzamide-5-pyrazolone,
1-(2',4',6'-trichlorophenyl)-3-anilino-5-pyrazolone,
1-phenyl-3-phenylacetamide-5-pyrazolone, the couplers shown below (illustrative compounds C-1 to C-6) and the like. These couplers may be used in combination to obtain a desired hue.

C-1

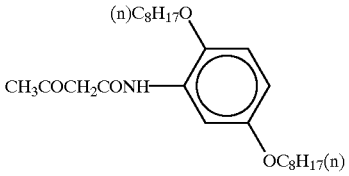

C-2

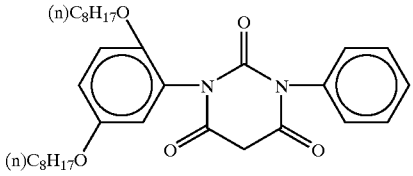

-continued

C-3

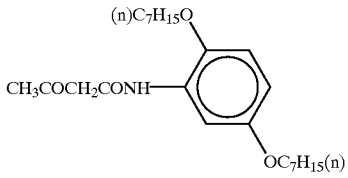

C-4

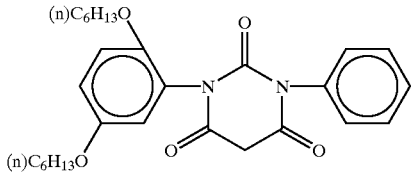

C-5

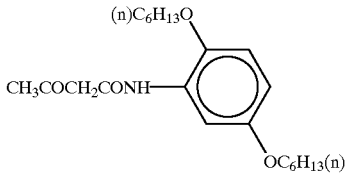

C-6

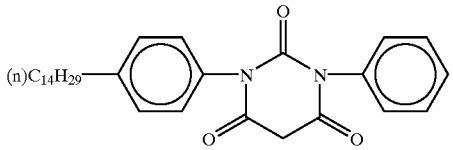

The basic material may be an inorganic or organic basic compound or, alternatively, a compound that decomposes or the like when heated and thereby releases alkaline material. Representative examples thereof include nitrogen-containing compounds such as: organic ammonium salts, organic amines, amides, urea and thiourea, and respective derivatives thereof; thiazoles; pyrroles; pyrimidines; piperazines; guanidines; indoles; imidazoles; imidazolines; triazoles; morpholines; piperidines; amidines; formazines; pyridines; and the like. Specific examples of these include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazinobenzothiazole and the like. Two or more of these may be used in combination.

Examples of the electron-donating dye precursor include triarylmethane-type compounds, diphenylmethane-type compounds, thiazine-type compounds, xanthene-type compounds, spiropyran-type compounds and the like. Of these, triarylmethane-type compounds and xanthene-type compounds are particularly effective with regard to high color density.

Examples include 3,3-bis(p-dimethylaminophenyl)-6-dimethylaminophthalide (i.e., crystal violet lactone),
3,3-bis(p-dimethylamino)phthalide,
3-(p-dimethylaminophenyl)-3-(1,3-dimethylindole-3-yl) phthalide,
3-(p-dimethylaminophenyl)-3-(2-methylindole-3-yl) phthalide,
3-(o-methyl-p-diethylaminophenyl)-3-(2-methylindole-3-yl)phthalide,
4,4'-bis(dimethylamino)benzhydryl benzyl ether, N-halophenyl leucoauramine, N-2,4,5-trichlorophenyl leucoauramine, rhodamine-B-anilinolactam, rhodamine (p-nitroanilino) lactam,
rhodamine-B-(p-chloroanilino)lactam,
2-benzylamino-6-diethylaminofluoran,
2-anilino-6-diethylaminofluoran,
2-anilino-3-methyl-6-diethylaminofluoran,
2-anilino-3-methyl-6-cyclohexylmethylaminofluoran,
2-anilino-3-methyl-6-isoamylethylaminofluoran,
2-(o-chloroanilino)-6-diethylaminofluoran,
2-octylamino-6-diethylaminofluoran,
2-ethoxyethylamino-3-chloro-2-diethylaminofluoran,
2-anilino-3-chloro-6-diethylaminofluoran,
benzoyl leucomethylene blue, p-nitrobenzyl leucomethylene blue,
3-methyl-spiro-dinaphthopyran, 3-ethyl-spiro-dinaphthopyran,
3,3'-dichloro-spiro-dinaphthopyran, 3-benzylspirodinaphthopyran,
3-propyl-spiro-dibenzopyran and the like.

Examples of the electron-accepting compound include phenol derivatives, salicylic acid derivatives, hydroxybenzoic esters and the like. Bisphenols and hydroxybenzoic esters are particularly preferable.

Examples include 2,2-bis(p-hydroxyphenyl)propane (i.e., bisphenol A),
4,4'-(p-phenylene diisopropylidene)diphenol (i.e., bisphenol P),
2,2-bis(p-hydroxyphenyl)pentane, 2,2-bis(p-hydroxyphenyl)ethane,
2,2-bis(p-hydroxyphenyl)butane,
2,2-bis(4'-hydroxy-3',5'-dichlorophenyl)propane,
1,1-(p-hydroxyphenyl)cyclohexane, 1,1-(p-hydroxyphenyl) propane,
1,1-(p-hydroxyphenyl)pentane,
1,1-(p-hydroxyphenyl)-2-ethylhexane,
3,5-di(α-methylbenzyl) salicylic acid and polyvalent metal salts thereof,
3,5-di(tert-butyl)salicylic acid and polyvalent metal salts thereof,
3-α,α-dimethylbenzyl salicylic acid and polyvalent metal salts thereof,
butyl p-hydroxybenzoate, benzyl p-hydroxybenzoate,
2-ethylhexyl p-hydroxybenzoate, p-phenylphenol, p-cumylphenol and the like.

A low-melting-point organic compound appropriately containing an aromatic group and a polar group in the molecule thereof can be preferably used as the sensitizer. Examples include benzyl p-benzyloxybenzoate, α-naphthyl benzyl ether,
β-naphthyl benzyl ether, phenyl β-naphthoate,
phenyl α-hydroxy- β-naphthoate,
β-naphthol-(p-chlorobenzyl)ether, 1,4-butanediolphenyl ether,
1,4-butanediol-p-methylphenyl ether,
1,4-butanediol-p-ethylphenyl ether,
1,4-butanediol-m-methylphenylether,
1-phenoxy-2-(p-tolyloxy)ethane,
1-phenoxy-2-(p-ethylphenoxy)ethane,
1-phenoxy-2-(p-chlorophenoxy)ethane, p-benzyl biphenyl and the like.

Modes of use of the diazonium salt compound and colorizing coupler that reacts with the diazonium salt compound when heated, the electron-donating colorless dye and electron-accepting compound, the basic material, the sensitizer and the like are not particularly limited. Examples include (1) a method using a solid dispersion, (2) a method using an emulsified dispersion, (3) a method using a polymer dispersion, (4) a method using a latex dispersion and (5) a method using microcapsulation. Of these, the method using microcapsulation is preferable in view of preservability. In particular, if color formation utilizes a reaction between a diazonium salt compound and a coupler, it is preferable that the diazonium salt compound is microcapsulated. And if color formation utilizes a reaction between an electron-donating colorless dye and an electron-accepting compound, it is preferable that the electron-donating colorless dye is microcapsulated.

Microcapsules

A conventionally known method can be used as a method for microcapsulating the electron-donating dye precursor or diazonium salt compound to be used (hereafter sometimes referred to as the "color-forming component").

Examples thereof include a method utilizing coacervation of a hydrophyllic wall-forming material, such as disclosed in U.S. Pat. Nos. 2,800,457 and 2,800,458; an interfacial polymerization method, such as disclosed in U.S. Pat. No. 3,287,154, British Patent (GBP) No. 990,443, and Japanese Patent Application Publication (JP-B) Nos. 38-19574, 42-446 and 42-771; a polymer precipitation method, such as disclosed in U.S. Pat. Nos. 3,418,250 and 3,660,304; a method using an isocyanate polyol wall material, such as disclosed in U.S. Pat. No. 3,796,669; a method using an isocyanate wall material, such as disclosed in U.S. Pat. No. 3,914,511; a method using a urea-formaldeyde or urea-formaldehyde resorcinol wall-forming material, such as disclosed in U.S. Pat. Nos. 4,001,140, 4,087,376 and 4,089,802; a method using melamine-formaldehyde resin, hydroxy propyl cellulose or the like as a wall-forming material, such as disclosed in U.S. Pat. No. 4,025,455; an in situ method based on monomer polymerization, such as disclosed in JP-B 36-9168 and Japanese Patent Application Laid-Open (JP-A) No. 51-9079; an electrolytic dispersion cooling method, such as disclosed in GBP 952,807 and GBP 965,074; a spray-drying method, such as disclosed in U.S. Pat. No. 3,111,407 and GBP 930,422; methods disclosed in JP-B 7-73069, JP-A 4-101885 and JP-A 9-263057; and the like.

The method of microcapsulation is not limited to these methods. However, it is particularly preferable to use an interfacial polymerization method of dissolving or dispersing the color-forming component in a hydrophobic organic solvent that is to become the core of the capsules, to make an oil phase, mixing the oil phase with an aqueous phase in which a water-soluble polymer is dissolved, emulsion-diepersing the mixture with a homogenizer or the like, and then heating to cause a polymer-forming reaction at oil droplet surfaces and thereby form high polymer microcapsule walls.

This interfacial polymerization method can form homogeneously-sized microcapsules in a short time, and can provide a recording material with excellent raw stock storability.

In microcapsules that are preferable for the present invention, the microcapsule walls (below referred to simply as "capsule walls") have a material isolating effect at usual temperatures, so as to prevent contact between materials inside and outside the capsules. It becomes possible for the materials inside and outside to make contact only when a temperature and/or pressure above a certain value is applied. This characteristic can be freely controlled by appropriate selection of a capsule wall material, capsule core material (material held inside the capsule), additives and the like.

The capsule wall material for the present invention is added inside and/or outside the oil droplets.

Examples of the capsule wall material include polyurethane resin, polyurea resin, polyamide resin, polyester resin, polycarbonate resin, aminoaldehyde resin, melamine resin, polystyrene resin, styreneacrylate copolymer resin, styrene-methacrylate copolymer resin, gelatin, polyvinyl alcohol and the like. Of these, polyurethane, polyurea, polyamide, polyester and polycarbonate are preferable, and polyurethane and polyurea are more preferable.

A combination of two or more of the above may be used for the polymer material.

For example, if polyurethane is used as the capsule wall material, a polyvalent isocyanate and a second material that will react therewith to form the capsule walls (e.g., a polyol or polyamine) are mixed into the water-soluble polymer solution (the aqueous phase) or into the oily medium that is to be encapsulated (the oil phase). The oil phase is emulsion-dispersed into the aqueous phase, and the polymer-forming reaction at the oil droplet surfaces is initiated by heating. Thus, the microcapsule walls are formed.

Substances disclosed in U.S. Pat. Nos. 3,281,383, 3,773,695, 3,793,268, JP-B 48-40347, JP-B 49-24159, JP-A 48-80191 and JP-A 48-84086 can be used as the polyvalent isocyanate and the polyol or polyamine that reacts therewith.

Some specific examples of the polyvalent isocyanate compound are given hereafter. The examples include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate and the like; triisocyanates such as 4,4',4"-triphenylmethane triisocyanate, toluene-2,4,6-triisocyanate and the like; tetraisocyanates such as 4,4'-dimethylphenylmethane-2,2',5,5'-tetraisocyanate and the like; isocyanate prepolymers such as an adduct of hexamethylene diisocyanate and trimethylol propane, an adduct of 2,4-tolylene diisocyanate and trimethylol propane, an adduct of xylylene diisocyanate and trimethylol propane, an adduct of tolylene diisocyanate and hexanetriol, and the like; and the like. A combination of two or more types thereof may be used as required. Of the above, materials whose molecules contain three or more isocyanate groups are particularly preferable.

When the microcapsules are formed, the color-forming component being enclosed may be present inside the capsules in a dissolved state or in a solid state. If the color-forming component is to be enclosed in the capsules in a dissolved state, the electron-donating colorless dye or diazonium salt compound that is the color-forming component should be encapsulated after being dissolved in an organic solvent.

The organic solvent can generally be appropriately selected from high-boiling-point solvents. Examples thereof include phosphoric esters, phthalic esters, acrylic esters, methacrylic esters, other carboxylic esters, fatty acid amides, alkylated biphenyls, alkylated terphenyls, chlorinated paraffin, alkylated naphthalene, diallylethane, compounds that are solid at room temperature, oligomer oils, polymer oils and the like. Specific examples include organic solvents disclosed in JP-A 59-178451 to JP-A 59-178455, JP-A 59-178457, JP-A 60-242094, JP-A 63-85633, JP-A 6-194825, JP-A 7-13310, JP-A 7-13311, JP-A 9-106039 and Japanese Patent Application No. 62-75409.

A usage amount of the organic solvent is preferably from 1 to 500 parts by weight for 100 parts by weight of the electron-donating colorless dye or diazonium salt compound.

Further, so-called oilless capsules, in which the above-described organic solvent is not used, may be used for encapsulation.

If solubility in the organic solvent of the electron-donating colorless dye or diazonium salt compound to be enclosed is low, the organic solvent can further be combined with a high-solubility low-boiling-point solvent, which serves as an auxiliary solvent. Alternatively, the low-boiling-point solvent can be used and the organic solvent not used.

Examples of the low-boiling-point solvent include ethyl acetate, propyl acetate, isopropyl acetate, butyl acetate, methylene chloride and the like.

The aqueous solution in which the water-soluble polymer is dissolved is used as the aqueous phase for emulsion-dispersion of the oil phase.

After the oil phase has been introduced into the aqueous phase, emulsion-dispersion is carried out with a homogenizer or the like. The water-soluble polymer is included to serve as a protective colloid for enabling easy, homogeneous dispersion, and also to serve as a dispersant for stabilizing the emulsion-dispersed aqueous solution. Here, a surfactant can be added to one or both of the oil phase and the aqueous phase in order to further homogenize and stabilize the emulsion dispersion.

Polyvinyl alcohol or the like can be used as the water-soluble polymer that is included to serve as a protective colloid. The same may also be combined with a hydrophobic polymer emulsion, or a latex or the like.

Examples of the water-soluble polymer include polyvinyl alcohol, silanol-denatured polyvinyl alcohol, carboxy-denatured polyvinyl alcohol, amino-denatured polyvinyl alcohol, itaconic acid-denatured polyvinyl alcohol, a styrene-maleic anhydride copolymer, a butadiene-maleic anhydride copolymer, an ethylene-maleic anhydride copolymer, an isobutylene-maleic anhydride copolymer, polyacrylamide, polystyrene sulfonic acid, polyvinyl pyrrolidone, an ethylene-acrylic acid copolymer, gelatin and the like. Of these, carboxy-denatured polyvinyl alcohol is particularly preferable.

Examples of the hydrophobic polymer emulsion or latex include a styrene-butadiene copolymer, a carboxy-denatured styrene-butadiene copolymer, an acrilonitrile-butadiene copolymer and the like.

The surfactant can be appropriately selected from among well known emulsification surfactants. For example, the surfactant can be appropriately selected from anionic and nonionic surfactants such that cohesion or precipitation of the above-described protective colloid will not be caused by an effect of the protective colloid. Specific examples include sodium alkylbenzene sulfonate, sodium alkyl sulfate, sodium dioctyl sulfosuccinate, polyalkylene glycol (e.g., polyoxyethylene nonyl phenyl ether) and the like.

An addition amount of the surfactant is preferably 0.1 to 5% by weight relative to the weight of the oil phase, and more preferably 0.5 to 2% by weight.

The color-forming component and all other components to be included, such as the water-soluble polymer, the sensitizer and other color-formation assistants, can be dispersed using solid dispersion by means of a sand mill or the like. However, it is preferable to use emulsion-dispersion: first dissolving these components in a high-boiling-point organic solvent that is insoluble or hard to dissolve in water, then mixing this solution with a polymer aqueous solution (the aqueous phase) that contains the surfactant and/or the water-soluble polymer that serves as the protective colloid, and emulsifying with a homogenizer or the like. In this case, a low-boiling-point solvent may be used as a dissolution assistant.

Further, the color-forming component and all the other components to be included can be respectively separately emulsion-dispersed, or can be mixed beforehand, dissolved in the high-boiling-point solvent and/or low-boiling-point solvent, and emulsion-dispersed.

The size of emulsion dispersion particles formed by emulsion-dispersion is desirably not more than 1 $\mu$m.

Emulsion-dispersion of the oil phase containing the components and the aqueous phase containing the surfactant and/or protective colloid can be performed easily using a technique of microparticle emulsification such as high-speed stirring, ultrasonic wave dispersion or the like. A known emulsification device can be used; for example, a homogenizer, a manton gaulin, an ultrasonic disperser, a dissolver, a KADY mill or the like.

After emulsification, in order to accelerate the capsule wall-forming reaction, the emulsion is heated to between 30 and 70° C. Further, in order to prevent the capsules cohering together during the reaction, addition of water to reduce the number of collisions between the capsules, thorough stirring and the like may be required.

It is also possible to add a separate, cohesion-prevention dispersion during the reaction.

Emissions of carbon gas can be observed accompanying progress of a polymerization reaction. Thus, for the capsule wall-forming reaction, when such emissions finish, it can be seen that the reaction has finished.

Usually, microcapsules enclosing the color-forming component can be obtained by performing this reaction for a period of several hours.

For the present invention, the size of the microcapsules is preferably from 0.1 to 1.0 $\mu$m, and more preferably from 0.2 to 0.7 $\mu$m. If the size of the formed microcapsules is too small, the surface area for each unit amount of solid will be large, and a large quantity of wall material will be required.

Protective Layer

The heat-sensitive recording material of the present invention preferably further has a protective layer on the heat-sensitive recording layer, and the protective layer preferably contains the microparticle-aggregation particles described earlier. That is, if the heat-sensitive recording material has the protective layer, the structure is such that the protective layer is the outermost layer.

Details of the amount of the microparticle-aggregation particles in the protective layer and the like, and of preferable modes and the like, are as described earlier.

The protective layer may include microparticles of pigment and the like. However, because the microparticle-aggregation particles are contained in the protective layer, both head-soiling and head-wearing of the thermal head can be improved together.

Further, together with the microparticle-aggregation particles, the protective layer has a binder, a pigment, a lubricant, a surfactant and the like. A cross-linking agent, a matting agent, a parting agent, a dispersion stabilizer, a water repellent and the like may be included in the protective layer as necessary. The protective layer may have a single-layer structure, or may have a laminated structure of two or more layers. The binder may also be provided with the capability to act as a lubricant.

Binder

Examples of the binder include polyvinyl alcohol-related compounds such as polyvinyl alcohol, denatured polyvinyl alcohol, alkylether-denatured polyvinyl alcohol and the like; silicone-denatured polymers; gelatin; methylcellulose; carboxymethylcellulose; hydroxyethylcellulose; starches; agar; K-carageenan; gum arabic; casein; a hydrolysate of a styrene-maleic anhydride copolymer; a hydrolysate of an ethylene-maleic anhydride copolymer; a hydrolysate of an isobutylene-maleic anhydride copolymer; polyacrylamide and the like.

Of these, the polyvinyl alcohol-related compounds and the silicone-denatured polymers are preferable. Of the polyvinyl alcohol-related compounds, the alkylether-denatured polyvinyl alcohol is particularly preferable. Details thereof can be found in the disclosure of JP-A 2000-118133. Moreover, another of the aforementioned binders may be combined therewith as necessary.

If the alkylether-denatured polyvinyl alcohol is used, alkyl groups tend to align at the surface of the protective layer. Thus, a coefficient of kinematic friction of the surface against the thermal head is lowered, and printing faults are reduced. At the same time, it can be expected that smoothness (glossiness) of the printing surface and color density will improve.

If a coefficient of static friction of the protective layer surface is lowered, runnability of a medium such as the heat-sensitive recording material or the like when recording at a printer or the like can be improved. Moreover, the alkylether-denatured polyvinyl alcohol, being a polyvinyl alcohol, exhibits excellent light resistance and film strength. Also, because hydrophobic groups are aligned at the surface, an improvement in water resistance is provided.

If the alkylether-denatured polyvinyl alcohol is used, the amount thereof included is preferably at least 50% by weight of the total amount of the binder in the protective layer, and more preferably at least 80% by weight.

If the included amount is less than 50% by weight, the above-described effects of using the alkylether-denatured polyvinyl alcohol may not be adequately provided.

Examples of a silicone-denatured polymer include silicone graft polymers, silicone block polymers, silicone-denatured acrylic polymers, silicone-denatured polyvinyl alcohol and the like. Of these, the silicone graft polymers are especially preferable. Suitable examples of the silicone graft polymers include silicone graft acrylic polymers and silicone graft-denatured polyvinyl alcohol.

That is, a trunk polymer of the silicone-denatured polymer may be any polymer having resin characteristics, that is, having excellent film-forming ability, excellent heat resistance, excellent light resistance, excellent film strength and a high Tg (glass transition temperature). Of such polymers, acrylic-type resins and polyvinyl alcohol-type resins are preferable.

Specifically, suitable silicone-denatured polymers are disclosed in JP-A 10-329427.

The Tg of the silicone-denatured polymer is preferably at least 60 ° C., more preferably at least 80° C., and most preferably at least 100° C. If the Tg is less than 60° C., lubricity with respect to the head during printing may be lowered.

If the silicone-denatured polymer is used, the amount thereof included is preferably 5 to 100% by weight of the total amount of the binder, and more preferably 50 to 90% by weight. If the amount is less than 5% by weight of the total amount, adequate heat resistance, light resistance and film strength may not be obtained.

Here, in view of obtaining smoothness and glossiness at a texture portion and the printing surface, it is preferable to have a set-dryable water-soluble polymer in the binder. The set-dryable water-soluble polymer is a water-soluble polymer that causes a coating to exhibit a predetermined viscosity when heated (e.g., to around 40° C.) and gels, thereby raising viscosity and terminating a fluid state, during subsequent cooling (e.g., to between 5 and 15° C.).

However, it is difficult for a silicone-denatured polymer that can provide a preferable binder to exhibit set-dryability if used alone. Consequently, when such polymer is used, it is combined with the set-dryable water-soluble polymer. Thus, the protective layer is formed with ease.

If the protective layer is formed by this method, the silicone-denatured polymer with the relatively high Tg tends to align in the vicinity of the protective layer surface. Consequently, hardness is high at a surface side of the protective layer. Thus, sticking and residue-adhesion to a heat-sensitive recording head or the like can be prevented, a smoothness-processing effect can be provided to the protective layer surface by the heat-sensitive recording head or the like, and a tracking characteristic of the heat-sensitive recording head or the like is improved, such that print failures can be eliminated and color density can be raised.

In view of excellent compatibility, the water-soluble polymer combined with the silicone-denatured polymer is particularly preferably gelatin. A ratio of the silicone-denatured polymer to the gelatin is preferably a weight ratio from 50/50 to 90/10.

Further, if a polyvinyl alcohol-type compound is used, if consideration is given to compatibility with the silicone-denatured polymer, silanol-denatured polyvinyl alcohol is preferable. Moreover, the silanol-denatured polyvinyl alcohol may be used as the set-dryable water-soluble polymer by combining the silanol-denatured polyvinyl alcohol with boric acid or a salt thereof which serves as a gelling agent.

If the silanol-denatured polyvinyl alcohol and the silicone-denatured polymer are used, a ratio of the silicone-denatured polymer to the silanol-denatured polyvinyl alcohol is preferably a weight ratio from 5/95 to 95/5, and more preferably from 50/50 to 90/10.

A synthetic rubber latex or a synthetic resin emulsion or the like can also be used as the binder.

Examples of monomers structuring the synthetic rubber latex or synthetic resin emulsion include acrylic ester, methacrylic ester, crotonic ester, vinyl ester, maleic diester, fumaric diester, itaconic diester, acrylamides, methacrylamides, vinyl ethers, styrenes, acrylonitriles and the like.

Cross-Linking Agent

It is also preferable to combine with the binder a cross-linking agent that causes a cross-linking reaction with the binder.

Furthermore, it is desirable for the silanol-denatured polyvinyl alcohol and/or silicone-denatured polymer to include at least one sort of functional group selected from a carboxy group, an amino group, an ammonium salt group, a hydroxy group, a sulfinic acid (or sulfinate) group, a sulfonic acid (or sulfonate) group and a glycidyl group.

Examples of agents that can be used as the cross-linking agent include vinyl sulfone-type compounds, aldehyde-type compounds (formaldehyde, glutaraldehyde, dialdehyde starch and the like), epoxy-type compounds, oxazine-type compounds, triazine-type compounds, a polymer hardening agent disclosed in JP-A 62-234157, methylated melamine, blocked isocyanates, methylol compounds, carbodiimide resins and the like.

Of these, the vinyl sulfone-type compounds, the aldehyde-type compounds, the epoxy-type compounds, the oxazine-type compounds, the triazine-type compounds and the polymer hardening agent disclosed in JP-A 62-234157 are suitable.

Of the aforementioned denatured polyvinyl alcohols, the silanol-denatured polyvinyl alcohol, which is capable of improving water resistance and the like unassisted, is particularly preferable. In order to further improve water resistance, it is effective to use the cross-linking agent and a catalyst to accelerate the cross-linking reaction, with the silanol-denatured polyvinyl alcohol.

Lubricant

Examples of the lubricant include waxes and silicone oils.

The wax is a compound that is solid below room temperature and has a melting point in the range 30 to 200° C., and any natural wax or synthetic wax can be suitably used as the wax. Of these compounds, compounds having a melting point from 50 to 150° C. are preferable.

Examples of natural waxes include vegetable waxes such as carnauba wax, Japan tallow and the like; animal waxes such as beeswax and the like; mineral waxes such as montan wax and the like; paraffin wax; oil waxes such as microcrystalline wax and the like; and the like. Examples of synthetic waxes include synthetic hydrocarbon waxes such as polyethylene wax and the like; denatured waxes such as montan wax derivatives, paraffin wax derivatives and the like; hydrogenated waxes such as solidified castor oil or the like; montanic ester wax; zinc stearate; stearic amide; methylol stearic amide; ethylene bis stearic amide; block polymers of polyethylene and ethoxylated alcohols (e.g., UNITOX, manufactured by Toyo Petrolite Co., Ltd.); tristearyl phosphate; and the like.

Of these, zinc stearate is particularly preferable.

The wax can be used as a solid-dispersed wax. A preferable method for regulating the wax dispersion, in view of dispersion stability, light resistance of a coating material (stain resistance) and the like, is a method capable of adsorbing the wax with a low molecular weight dispersant, homogeneously dispersing the wax in a microparticle state, adsorbing and dispersing this dispersion with a high molecular weight dispersant, and removing the low molecular weight dispersant. Examples of the low molecular weight dispersant include low molecular weight nonionic surfactants, low molecular weight anionic surfactants, low molecular weight betaine surfactants and the like. Examples of the high molecular weight dispersant include high molecular weight surfactants, denatured and undenatured polyvinyl alcohols, water-soluble acrylic resins having acrylic acid or methacrylic acid as a main component, water-soluble cellulose derivatives (e.g., carboxymethylcellulose, etc.), alkyl-terminated polyglycerine and the like.

An amount of wax included in the wax dispersion is preferably 5 to 50% by weight, and more preferably 10 to 35% by weight.

An amount of wax included in the protective layer is preferably 5 to 30% by weight of all solid components in the protective layer, and more preferably 7 to 20% by weight.

If an aforementioned silicone oil is to be used and is non-aqueous, the same can be added as an emulsion. If the silicone oil is aqueous, the same can simply be blended with a coating liquid.

Pigment

In order to further improve wear resistance and lubricity, a known organic or inorganic pigment may be appropriately selected and used.

Examples of the pigment include calcium carbonate, aluminium hydroxide, barium sulfate, titanium oxide, talc, agalmatolite, kaolin, calcined kaolin, amorphous silica, urea-formalin resin powder, polyethylene resin powder, benzoguanamine resin powder and the like. These can be used singly, or two or more can be mixed for use.

With regard to preventing loss of glossiness, it is particularly preferable if the pigment is inorganic ultra-fine particles. Inorganic ultra-fine particles means particles whose mean primary dimension is not more than 0.1 $\mu$m. The particles are not particularly limited provided the mean size thereof is 0.1 $\mu$m or smaller, but a maximum particle size in a dispersion solution (large-end threshold value of a distribution of particle sizes in the dispersion solution) is preferably not more than 0.5 $\mu$m, more preferably not more than 0.4 $\mu$m, and most preferably not more than 0.35 $\mu$m.

The particle sizes can be measured by a known method, for example, a COULTER N4 type sub-micron particle analyzer (Nikkaki Bios Co., Ltd.) or the like.

Examples of the inorganic ultra-fine particles include barium sulfate, zinc oxide, magnesium oxide, lead oxide, zirconium oxide, colloidal silica, alumina and the like. Of these, barium sulfate, colloidal silica and alumina are preferable. Examples of products available on the market that are inorganic fine particles having a mean primary particle dimension of not more than 0.1 $\mu$m and being suitable for use in the present invention include: BARIFINE BF-21 (barium sulfate), BARIFINE BF-20 (barium sulfate) and FINEX-75 (zinc oxide) (all manufactured by Sakai Chemical Industry Co., Ltd.); NZR-A (zirconium oxide, manufactured by Nissan Chemical Industries, Ltd.); TTO-55 (titanium oxide, manufactured by Ishihara Sangyo Kaisha, Ltd.); silica manufactured by Nippon Aerosil; and the like With regard to production quality and effects of preventing cohering of the microparticles and achieving homogeneous adsorption to resin particle surfaces, preferable methods for blending the inorganic ultra-fine particles into a coating liquid for forming the protective layer (a protective layer coating liquid) include a method of blending the inorganic ultra-fine particles with an aqueous dispersion resin such as carboxymethylcellulose, gelatin or polyvinyl alcohol to make a resin solution, a method of blending after the colloid dispersion has been adjusted in various sorts of mill or the like, and the like.

A usage amount of the pigment can be suitably selected from a range such that the effects of the present invention are not disrupted.

Matting Agent

Examples of the matting agent include microparticles such as starch particles obtained from barley, wheat, corn, rice, beans and the like; cellulose fibers; synthetic polymer microparticles such as polystyrene resins, epoxy resins, polyurethane resins, urea-formalin resins, poly(meth) acrylate resins, polymethyl(meth)acrylate resin, copolymer resins of vinyl chloride, vinyl acetate and the like, and polyolefin and the like; inorganic microparticles such as calcium carbonate, titanium oxide, kaolin, aluminium hydroxide, silica, zinc oxide and the like; and the like.

Two or more of these matting agents may be combined.

The protective layer may be formed by coating the coating liquid for forming the protective layer onto the heat-sensitive recording layer using a known device such as a bar coater, an air knife coater, a blade coater, a curtain coater or the like, and drying the coating. The protective layer may be coated at the same time as the heat-sensitive recording layer, or may be coated onto the heat-sensitive recording layer after the heat-sensitive recording layer has been coated and dried for a period.

A dry-coat amount of the protective layer is preferably 0.1 to 3 g/m$^2$, and more preferably 0.3 to 2.0 g/m$^2$. If the coating amount is too large, heat sensitivity may be significantly reduced. And if the coating amount is too small, the functions of the protective layer (wear resistance, lubrication, scratch resistance, etc.) will not be sufficiently provided. After the protective layer has been coated, a calendering treatment and the like may be applied as necessary.

Other Layers

Other layers, such as an intermediate layer, an undercoat and the like, can be provided in the heat-sensitive recording material of the present invention as necessary.

Intermediate Layer

If a plurality of heat-sensitive recording layers are to be stacked on the substrate to form a multi-color heat-sensitive recording material, it is preferable that intermediate layers which are non-color-forming layers be provided between respective recording layers.

The intermediate layer is mainly formed of a binder. Additives may be included as necessary, such as a hardener, a polymer latex, a filter dye, a swellable layer-shaping compound (e.g., swellable synthetic mica), ultra-fine particles, an ultraviolet absorber and the like.

Examples of the binder include, besides the water-soluble polymer used for the encapsulation of the color-forming component, polystyrene; polyvinyl formal; polyvinyl butyral; acrylic resins such as polymethyl acrylate, polybutyl acrylate, polymethyl methacrylate and polybutyl methacrylate, and copolymers thereof; solvent-soluble polymers such as phenol resin, styrene-butadiene resin, ethylcellulose, epoxy resin, urethane resin and the like; latexes of the solvent-soluble polymers; and the like.

Of these, gelatin and polyvinyl alcohol are preferable.

Undercoat Layer

In order to prevent the heat-sensitive recording layer peeling off from the substrate, an undercoat layer can also be provided, between the substrate and the heat-sensitive recording layer.

Gelatin, polyvinyl alcohol-type compounds, acrylic acid ester copolymers, polyvinylidene chloride, SBR, aqueous polyester and the like can be used in the undercoat layer. In particular, an undercoat layer disclosed in JP-A 11-5366, which includes synthetic mica which is swellable by oil, is preferable.

When the heat-sensitive recording layer is coated and formed on the undercoat layer, the undercoat layer may be swelled by water content in the coating liquid, which could cause an image recorded on the heat-sensitive recording layer to deteriorate. Therefore, it is preferable to harden the undercoat layer using a hardener such as boric acid or the like and a dialdehyde such as glutaraldehyde, 2,3-dihydroxy-1,4-dioxane or the like.

An addition amount of the hardener can be selected, from a range of 0.2 to 3.0% by weight of total solids of the undercoat layer, to realize a desired degree of hardness.

Transmittance-Regulating Layer

At least one transmittance-regulating layer can be provided in the heat-sensitive recording material. The transmittance-regulating layer is preferably formed between the heat-sensitive recording layer and the outer protective layer. The transmittance-regulating layer may be integrated with the protective layer to form a dual-purpose layer. If the transmittance-regulating layer is integrated with the protective layer, the transmittance-regulating layer, being the outermost layer, contains the microparticle-aggregation particles described earlier.

Characteristics of the transmittance-regulating layer can be freely selected in accordance with characteristics of a light-fixing-type heat-sensitive recording layer.

The transmittance-regulating layer contains a component that functions as a precursor of an ultraviolet absorber. This component does not function as an ultraviolet absorber until light in a wavelength range necessary for fixing has irradiated. Thus, transmittance is high and, when the light-fixing-type heat-sensitive recording layer is to be fixed, plenty of light in the necessary wavelength range for fixing is transmitted. Also, visible light transmittance is high, so the transmittance-regulating layer does not cause failures in fixing of the heat-sensitive recording layer.

After irradiation onto the light-fixing-type heat-sensitive recording layer of the light in the necessary wavelength range for light-irradiation fixing has finished, a reaction of the ultraviolet absorber precursor is caused by heat or light or the like, so that the ultraviolet absorber precursor subsequently functions as the ultraviolet absorber. Thus, light in a wavelength range necessary for ultraviolet-range fixing is mostly absorbed by the ultraviolet absorber, transmittance is low, and the light resistance of the heat-sensitive recording layer is improved. However, there is no effect on visible light, and visible light transmittance is substantially unchanged. A compound disclosed in JP-A 9-1928 can be used as the ultraviolet absorber precursor.

Below, a specific structural mode of a multi-color heat-sensitive recording material is described.

The heat-sensitive recording material of the present invention may be a multi-color heat-sensitive recording material having a heat-sensitive recording layer with a laminated structure, in which single-color heat-sensitive recording layers are plurally stacked. For the multi-color heat-sensitive recording material, a mode is preferable in which at least one of the layers structuring the heat-sensitive recording layer is a light-fixing-type heat-sensitive recording layer including a diazonium salt compound and a colorizing coupler that reacts with the diazonium salt compound. For example, structure may be as in the modes shown in (a) to (c) following, or the like.

(a) A heat-sensitive recording material having a heat-sensitive recording layer in which a first heat-sensitive recording layer (layer A) and a second heat-sensitive recording layer (layer B) are stacked on a substrate. The first heat-sensitive recording layer is a light-fixing-type heat-sensitive recording layer containing a diazonium salt compound with a wavelength of maximum absorption of 360±20 nm and a colorizing coupler that reacts with the diazonium salt compound. The second heat-sensitive recording layer is a light-fixing-type heat-sensitive recording layer containing a diazonium salt compound with a wavelength of maximum absorption of 400±20 nm and a colorizing coupler that reacts with the diazonium salt compound. A transmittance-regulating layer and a protective layer are provided on these layers as necessary.

(b) A heat-sensitive recording material having a heat-sensitive recording layer in which a first heat-sensitive recording layer (layer A), a second heat-sensitive recording layer (layer B) and a third heat-sensitive recording layer (layer C) are stacked in that order on a substrate. The first heat-sensitive recording layer is a heat-sensitive recording layer containing an electron-donating dye and an electron-accepting compound. The second heat-sensitive recording layer is a light-fixing-type heat-sensitive recording layer containing a diazonium salt compound with a wavelength of maximum absorption of 360±20 nm and a colorizing coupler that reacts with the diazonium salt compound. The third heat-sensitive recording layer is a light-fixing-type heat-sensitive recording layer containing a diazonium salt compound with a wavelength of maximum absorption of 400±20 nm and a colorizing coupler that reacts with the diazonium salt compound. A transmittance-regulating layer and a protective layer are provided on these layers as necessary.

(c) A heat-sensitive recording material having a heat-sensitive recording layer in which a first heat-sensitive recording layer (layer A), a second heat-sensitive recording layer (layer B) and a third heat-sensitive recording layer (layer C) are stacked in that order on a substrate. The first heat-sensitive recording layer is a light-fixing-type heat-sensitive recording layer containing a diazonium salt compound with a wavelength of maximum absorption of 340±20 nm and a colorizing coupler that reacts with the diazonium salt compound. The second heat-sensitive recording layer is a light-fixing-type heat-sensitive recording layer containing a diazonium salt compound with a wavelength of maximum absorption of 360±20 nm and a colorizing coupler that reacts with the diazonium salt compound. The third heat-sensitive recording layer is a light-fixing-type heat-sensitive recording layer containing a diazonium salt compound with a wavelength of maximum absorption of 400±20 nm and a colorizing coupler that reacts with the diazonium salt compound. A transmittance-regulating layer and a protective layer are provided on these layers as necessary.

A method for multi-color recording is explained below with reference to (b) and (c) above.

Firstly, the third heat-sensitive recording layer (layer C) is heated, and the diazonium salt compound and coupler in layer C form color. Then, light with a wavelength of 400±20 nm is irradiated, and unreacted diazonium salt compound contained in layer C is decomposed and light-fixed. Next, sufficient heat to cause color-forming in the second heat-sensitive recording layer (layer B) is applied, and the diazonium salt compound and coupler in layer B form color. At this time, layer C is also being heated strongly, but the diazonium salt compound therein has already been decomposed (light-fixed). Thus, layer C has lost any color-forming ability and does not form color at this time. Then, light with a wavelength of 360±20 nm is irradiated, and unreacted diazonium salt compound contained in layer B is decomposed and light-fixed. Finally, sufficient heat to cause color-forming in the first heat-sensitive recording layer (layer A) is applied, and color is formed therein. At this time, layers B and C are also being heated strongly, but the diazonium salt compounds therein have already been decomposed (light-fixed). Thus, layers B and C have lost any color-forming ability and do not form color at this time.

The stacking order of the layers is such that a yellow layer, which has low visibility, is the lowest layer. Consequently, an effect of roughness of the substrate on picture quality can be reduced. This is particularly worthwhile if an improvement in picture quality is to be achieved.

Also, if all of the heat-sensitive recording layers (layers A, B and C) are heat-sensitive recording layers containing diazo compounds, although light-fixing must be performed after color formation for layers B and C, light-fixing is not necessarily required for the last layer to undergo image-recording, layer A. However, with regard to improving preservation stability of a formed image, it is preferable to perform light-fixing for layer A.

A fixing light source for light-fixing can be suitably selected from known light sources. Examples thereof include various fluorescent lamps, xenon lamps, mercury lamps and the like. Of these, in view of high efficiency of light-fixing, it is preferable to use a light source whose emission spectrum strongly matches the absorption spectrum of the diazonium salt compound used in the heat-sensitive recording material.

Moreover, the heat-sensitive recording material of the present invention can be used as a heat-development-type photosensitive material. First, light-exposure is performed through an original positioned over the heat-sensitive recording layer of the heat-sensitive recording material, to decompose the diazonium salt compound at a non-image portion and form a latent image. Then, the whole of the heat-sensitive recording material is heated and an image is formed.

The heat-sensitive recording material of the present invention can be produced by performing dispersion or dissolution in a solvent for each component as necessary to thereby make a heat-sensitive recording layer coating liquid, a protective layer coating liquid and the like, coating the same onto a desired substrate, and drying.

The solvent is preferably water. However, an organic solvent that is capable of mixing with water, such as alcohol, a ketone or the like, can be combined with the water.

Examples of a coating means for coating the heat-sensitive recording layer coating liquid include a blade coater, rod coater, knife coater, roll doctor coater, reverse roll coater, transfer roll coater, gravure coater, kiss roll coater, curtain coater, extrusion coater and the like. Coating can be performed with reference to a method disclosed in Research Disclosure, Vol. 200 (December 1980, Item 20036, page XV).

The thickness of the heat-sensitive recording layer is preferably 0.1 to 50 $\mu$m, and more preferably 5 to 35 $\mu$m.

Examples of the substrate used in the heat-sensitive recording material include synthetic papers such as neutral paper, acidic paper, coated paper, laminated paper and the like, films such as polyethylene terephthalate film, cellulose triacetate film, polyethylene film, polystyrene film, polycarbonate film and the like; and metal plates of aluminum, zinc, copper and the like. These may be subjected to various treatments for a substrate surface, such as surface processing, undercoating, metallic vapor processing and the like. A substrate disclosed in Research Disclosure, Vol. 200 (December 1980, Item 20036, page XVII) can also be used.

Each of these substrates can also have a fluorescent brightener, a blueing dye, a pigment or the like included therein.

EXAMPLES

The present invention is explained below by Examples. The present invention is not limited to these Examples. Hereafter "parts" and "%" signify "parts by weight" and "% by weight", respectively.

Example 1

1) Preparation of a Substrate

Wood pulp composed of 100 parts of LBKP was beaten to a Canadian Freeness of 300 cc by a double disc refiner. To the pulp were added 0.5 parts of epoxidized behenic acid amide, 1.0 part of anionic polyacrylamide, 0.1 parts of polyamidepolyamine-epichlorohydrin and 0.5 parts of cationic polyacrylamide, each ratio being absolute dry weight relative to the weight of the pulp. This pulp was fed to a long-mesh paper machine to produce base paper having a weight of 100 g/m$^2$. The base paper was sized with 1.0 g/m$^2$ absolute dry weight of polyvinyl alcohol and was adjusted to a specific gravity of 1.0 by calendering to provide foundation paper.

A wire-facing side (back side) of this paper was subjected to corona discharge treatment, and was then coated by a melt-extruder to a thickness of 30 $\mu$m with a high-density polyethylene resin. Thus, a resin layer having a matte surface was formed (this face is hereafter referred to as "back face"). The polyethylene-coated back face side was subjected to corona discharge treatment, and was then coated with an anti-static agent, which was an aqueous dispersion of aluminum oxide (ALUMINA SOL 100, produced by Nissan Chemical Industries, Ltd.) and silicon dioxide (SNOWTEX O, produced by Nissan Chemical Industries, Ltd.) in a 1:2 weight ratio, such that the weight of this coating after drying would be 0.2 g/m$^2$ (thus providing a PE-backed laminate).

A felt face side was a side of the base paper (which had been provided with the resin layer) at which the resin layer was not provided. The felt face side was subjected to corona discharge treatment, and was then coated by a melt-extruder to a thickness of 40 $\mu$m with a low-density polyethylene resin containing 10% titanium dioxide and a trace amount of ultramarine. Thus, a resin layer having a glossy surface was formed (this face is hereafter referred to as "front face"). The polyethylene-coated front face side was subjected to corona discharge treatment and was then coated with a gelatin undercoat such that the weight of this coating after drying would be 0.1 g/m$^2$.

Accordingly, resin layers were formed at both the front and back of the base paper, and a paper substrate was obtained.

2) Preparation of a Coating Liquid for an Undercoat Layer 97.5 parts of water and 2.5 parts of a synthetic mica that is swellable by oil (ME 100, produced by Co-op Chemical Co. Ltd.) were dispersed together in a dyno mill. This dispersion was added to 200 g of a 5% aqueous solution of gelatin at 40° C., and stirred for 30 minutes. Then, 20 cc of a 5% aqueous solution of surfactant-1, shown below, was added. Thus, the coating liquid for the undercoat layer was provided.

Surfactant-1

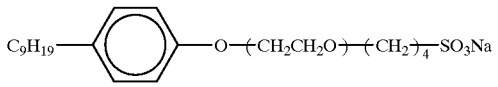

3) Preparation of a Coating Liquid for a Cyan Heat-Sensitive Recording Layer

Preparation of an Electron-Donating Dye Precursor-Encasing Microcapsule Liquid

① Liquid A 5 parts of 3-(o-methyl-p-dimethylaminophenyl)-3-(1'-ethyl-2'-methylindole-3-yl)phthalide (the electron-donating dye precursor) was dissolved in 20 parts of ethyl acetate. To this solution was added 20 parts of alkyl naphthalene (a high-boiling-point solvent), and this was heated and homogeneously mixed.

To the resulting solution was added 20 parts of a 1:3 weighted adduct of xylylene diisocyanate and trimethylol propane. The solution was homogeneously stirred and liquid A was obtained.

② Liquid B 2 parts of a 2% aqueous solution of sodium dodecylsulfonate was added to 54 parts of a 6% aqueous solution of phthalated gelatin. Thus, liquid B was obtained.

Liquid A was added to liquid B, and emulsion-dispersed using a homogenizer to obtain an emulsion dispersion. 68 parts of water was added to this emulsion dispersion and homogeneously mixed. Then this mixture was heated to 50° C. while being stirred. An encapsulation reaction was carried out for 3 hours so as to produce microcapsules having a mean particle size of 1.2 $\mu$m. Thus, the electron-donating dye precursor-encasing microcapsule solution was obtained.

Preparation of an Emulsion Dispersion of a Developer 2.5 parts of 1,1-(p-hydroxyphenyl)-2-ethylhexane (a developer), 0.3 parts of tricresyl phosphate and 0.1 parts of diethyl maleate were dissolved in 10 parts of ethyl acetate. This solution was introduced into a solution in which 20 parts of a 6% aqueous solution of gelatin and 2 parts of a 2% aqueous solution of sodium dodecylsulfonate had been mixed. This was emulsified for 10 minutes with a homogenizer. Thus, the emulsion dispersion of the developer was obtained.

Preparation of the Coating Liquid

To the electron-donating dye precursor-encasing microcapsule solution prepared earlier was added an SBR latex (SN-307, produced by Sumitomo Naugatuck Co. Ltd.) in an amount of 40% relative to capsule solids. To this solution was added the emulsion dispersion of the developer in a weight ratio (the emulsion dispersion: the electron-donating dye precursor-encasing microcapsule solution) of 1:4. Thus, the coating liquid for the cyan heat-sensitive recording layer was obtained.

4) Preparation of a Coating Liquid for a Magenta Heat-Sensitive Recording Layer

Preparation of Diazo Compound-Encasing Microcapsule Liquid (i)

2.0 parts of diazo compound (1) (decomposable by light with a wavelength of 365 nm), shown below, was dissolved in 20 parts of ethyl acetate. Then, 20 parts of alkylnaphthalene was added, and this mixture was heated and mixed homogeneously. To the resulting solution was added 15 parts of a 1:3-weighted adduct of xylylene diisocyanate and trimethylol propane (a capsule wall agent). The solution was homogeneously stirred and a diazo compound solution was obtained.

The diazo compound solution was added to a solution in which 54 parts of a 6% aqueous solution of phthalated gelatin and 2 parts of a 2% aqueous solution of sodium dodecylsulfonate had been mixed. This was emulsion-dispersed using a homogenizer. Next, 68 parts of water was added to the resulting emulsion dispersion and homogeneously mixed. Then this mixture was heated to 40° C. while being stirred. An encapsulation reaction was carried out for 3 hours so as to produce microcapsules having a mean particle size of 1.2 μm. Thus, diazo compound-encasing microcapsule liquid (i) was obtained.

Diazo compound (1)

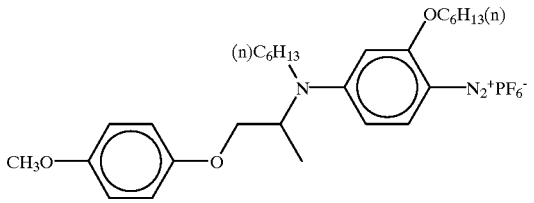

Preparation of Coupler Emulsion Dispersion (i)

2 parts of coupler (1), shown below, 2 parts of 1,2,3-triphenyl guanidine, 0.3 parts of tricresyl phosphate and 0.1 parts of diethyl maleate were dissolved in 10 parts of ethyl acetate. This solution was introduced into a solution in which 20 parts of a 6% aqueous solution of gelatin and 2 parts of a 2% aqueous solution of sodium dodecylsulfonate had been mixed. This was emulsified for 10 minutes with a homogenizer. Thus, coupler emulsion dispersion (i) was obtained.

Coupler (1)

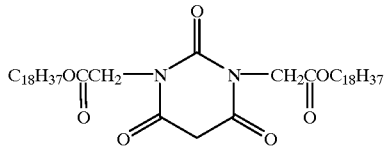

Preparation of the Coating Liquid

To diazo compound-encasing microcapsule liquid (i) prepared earlier was added an SBR latex (SN-307, produced by Sumitomo Naugatuck Co. Ltd.) in an amount of 40% relative to capsule solids. Then, the coupler emulsion dispersion (i) was mixed with the diazo compound-encasing microcapsule liquid (i) in a weight ratio of 3:2. Thus, the coating liquid for the magenta heat-sensitive recording layer was obtained.

5) Preparation of a Coating Liquid for a Yellow Heat-Sensitive Recording Layer

Preparation of Diazo Compound-Encasing Microcapsule Liquid (ii)

3.0 parts of 2,5-dibutoxy-4-tolylthiobenzenediazonium hexafluorophosphate (a diazo compound: decomposable by light with a wavelength of 420 nm) was dissolved in 20 parts of ethyl acetate. Then 20 parts of alkylnaphthalene, a high-boiling-point solvent, was added thereto, and this mixture was heated and mixed homogeneously.

To the resulting solution was added 15 parts of a 1:3 weighted adduct of xylylene diisocyanate and trimethylol. The solution was homogeneously stirred and a diazo compound solution was obtained.

The diazo compound solution was added to a solution in which 54 parts of a 6% aqueous solution of phthalated gelatin and 2 parts of a 2% aqueous solution of sodium dodecylsulfonate had been mixed. This was emulsion-dispersed using a homogenizer. Next, 68 parts of water was added to the resulting emulsion dispersion and homogeneously mixed. Then this mixture was heated to 40° C. while being stirred. An encapsulation reaction was carried out for 3 hours so as to produce microcapsules having a mean particle size of 1.3 μm. Thus, diazo compound-encasing microcapsule liquid (ii) was obtained.

Preparation of Coupler Emulsion Dispersion (ii)

2 parts of 2-chloro-5-(3-(2,4-di-tert-pentyl) phenoxypropylamino)acetoacetanilide, 1 part of 1,2,3-triphenyl guanidine, 0.3 parts of tricresyl phosphate and 0.1 parts of diethyl maleate were dissolved in 10 parts of ethyl acetate. This solution was introduced into a solution in which 20 parts of a 6% aqueous solution of gelatin and 2 parts of a 2% aqueous solution of sodium dodecylsulfonate had been mixed. This was emulsified for 10 minutes with a homogenizer. Thus, coupler emulsion dispersion (ii) was obtained.

Preparation of the Coating Liquid

The coupler emulsion dispersion (ii) was mixed with the diazo compound-encasing microcapsule liquid (ii) in a weight ratio of 3:2. Thus, the coating liquid for the yellow heat-sensitive recording layer was obtained.

6) Preparation of an Intermediate Layer Coating Liquid 10 parts of a 15% aqueous solution of gelatin (#750, produced by Nitta Gelatin Inc.) and 3 parts of a 15% aqueous solution of polyacrylic acid (JULIMER AC-10L, produced by Nippon Junyaku Co., Ltd.) were homogeneously mixed together, and the intermediate layer coating liquid was obtained.

7) Preparation of a Transmittance-Regulating Layer Coating Liquid 1.5 parts of the compound shown below, 0.5 parts of following compound R-6 as a reducing agent and 0.8 parts of tricresyl phosphate were thoroughly mixed and dissolved in 6.0 parts of ethyl acetate. To the resulting solution was added 3.0 parts of an adduct of xylylene diisocyanate and trimethylol propane (75% ethyl acetate solution, tradename: TAKENATE D110ON, produced by Takeda Chemical Industries, Ltd.) as a capsule wall-forming agent. The solution was homogeneously stirred, 29.7 parts of an 8% aqueous solution of carboxy-denatured polyvinyl alcohol (KL-318, produced by Kuraray Co., Ltd.) was added thereto, and emulsion-dispersion was performed with a homogenizer.

The resulting emulsion was added to 40 parts of ion-exchange water, and stirred for 3 hours at 40° C. to carry out an encapsulation reaction. 7.0 parts of ion-exchange resin was added, and the stirring was continued for a further 1 hour. Thus, the transmittance-regulating layer coating liquid was obtained. The mean particle size of the capsules was 0.35 μm.

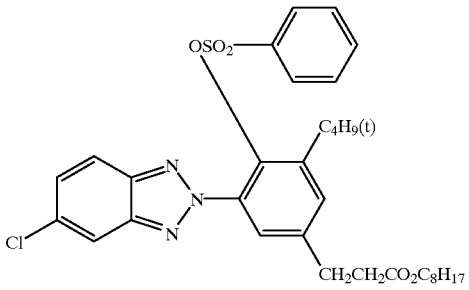

R-6

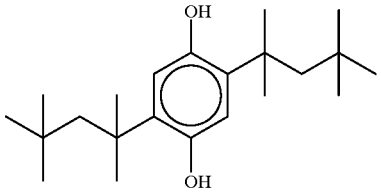

8) Preparation of Protective Layer Coating Liquid (1)

The compounds of the following composition were mixed, and protective layer coating liquid (1) was obtained.

| Composition | |
|---|---|
| EP130 (7%) (dodecyl-denatured polyvinyl alcohol, produced by Denki Kagaku Kogyo, K.K.) | 100 g |
| Water | 50 g |
| SILICA MICROBEAD P500 dispersion (20%) (microparticle-aggregation particles, produced by Catalyst & Chemicals Ind. Co., Ltd. mean particle size of the microparticle aggregation particles: 1.8 $\mu$m, Mohs' hardness: 7) | 10 g |
| Aforementioned surfactant-1 (2%) | 5 ml |
| Following surfactant-2 (5%) | 5 ml |
| Zinc stearate dispersion (20%) | 3 g |

Surfactant-2

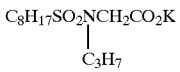

9) Fabrication of a Heat-Sensitive Recording Material

A plurality of layers was coated onto the front face of the polyethylene-laminated paper substrate in the following order (from the substrate side): the undercoat layer coating liquid, the cyan heat-sensitive recording layer coating liquid, the intermediate layer coating liquid, the magenta heat-sensitive recording layer coating liquid, the intermediate layer coating liquid, the yellow heat-sensitive recording layer coating liquid, the transmittance-regulating layer coating liquid, and the protective layer coating liquid. The layers were dried, and a multi-color heat-sensitive recording material (1) of the present invention was obtained.

A coating amount of each layer was calculated for solids after drying: 1.0 g/m$^2$ for the undercoat layer, 6.1 g/m$^2$ for the cyan heat-sensitive recording layer, 1.0 g/m$^2$ for one of the intermediate layers, 7.8 g/m$^2$ for the magenta heat-sensitive recording layer, 1.0 g/m$^2$ for another of the intermediate layers, 7.2 g/m$^2$ for the yellow heat-sensitive recording layer, 1.5 g/m$^2$ for the transmittance-regulating layer, and 1.2 g/m$^2$ for the protective layer.

Example 2

8') Preparation of Protective Layer Coating Liquid (2)

The compounds of the following composition were mixed, and protective layer coating liquid (2) was prepared. Then, a multi-color heat-sensitive recording material (2) of the present invention was prepared in the same way as for Example 1, except that protective layer coating liquid (2) was used in place of the protective layer coating liquid (1) that was used in Example 1.

| Composition | |
|---|---|
| EP130 (7%) (dodecyl-denatured polyvinyl alcohol, produced by Denki Kagaku Kogyo, K.K.) | 100 g |
| Water | 52 g |
| BARIFINE BF 21 dispersion (20%) (barium sulfate microparticles, produced by Sakai Chemical Industry Co., Ltd.) | 5 g |
| SILICA MICROBEAD P500 dispersion (20%) (microparticle-aggregation particles, produced by Catalyst & Chemicals Ind. Co., Ltd.) | 5 g |
| Aforementioned surfactant-1 (2%) | 10 ml |
| Aforementioned surfactant-2 (5%) | 10 ml |
| Zinc stearate dispersion (20%) | 3 g |

Comparative Example 1

A protective layer coating liquid (3) was prepared in the same way as protective layer coating liquid (1), except that a BARIFINE BF21 (20%) dispersion (barium sulfate microparticles, produced by Sakai Chemical Industry Co., Ltd.) was used in place of the SILICA MICROBEAD P500 (20%) dispersion (microparticle-aggregation particles) that was used in preparing protective layer coating liquid (1) in Example 1.

A Comparative Example multi-color heat-sensitive recording material (3) was prepared in the same way as for Example 1, except that protective layer coating liquid (3) was used in place of the protective layer coating liquid (1) that was used in Example 1.

Comparative Example 2

A protective layer coating liquid (4) was prepared in the same way as protective layer coating liquid (1), except that SNOWTEX C (20%) (colloidal silica dispersion, produced by Nissan Chemical Industries, Ltd.) was used in place of the SILICA MICROBEAD P500 (20%) dispersion (microparticle-aggregation particles) that was used in preparing protective layer coating liquid (1) in Example 1.

A Comparative Example multi-color heat-sensitive recording material (4) was prepared in the same way as for Example 1, except that protective layer coating liquid (4) was used in place of the protective layer coating liquid (1) that was used in Example 1.

Comparative Example 3

8") Preparation of a Protective Layer Coating liquid

The compounds of the following composition were mixed, and protective layer coating liquid (5) was prepared. Then, a Comparative Example multi-color heat-sensitive recording material (5) was prepared in the same way as for Example 1, except that protective layer coating liquid (5) was used in place of the protective layer coating liquid (1) that was used in Example 1.

| Composition | |
|---|---|
| EP130 (7%) (dodecyl-denatured polyvinyl alcohol, produced by Denki Kagaku Kogyo, K.K.) | 100 g |
| Water | 50 g |
| SILTON AMT-25 dispersion (20%) (aluminosilicate, mean particle size 2 μm, produced by Mizusawa Chemical Co., Ltd.) | 10 g |
| Aforementioned surfactant-1 (2%) | 10 ml |
| Aforementioned surfactant-2 (5%) | 10 ml |
| Dialdehyde starch (5%) | 14 g |
| p-toluene sulfonic acid (10%) | 0.7 g |
| Zinc stearate dispersion (20%) | 3 g |

Comparative Example 4

A protective layer coating liquid (6) was prepared in the same way as protective layer coating liquid (5), except that SILTON AMT-SILICA #300 (20%) (mean particle size 3 μm, produced by Mizusawa Chemical Co., Ltd.) was used in place of the SILTON AMT-25 (20%) dispersion that was used in preparing the protective layer coating liquid (5) used in Comparative Example 3.

A Comparative Example multi-color heat-sensitive recording material (6) was prepared in the same way as for Example 1, except that protective layer coating liquid (6) was used in place of the protective layer coating liquid (1) that was used in Example 1.

Head-Soiling Evaluation

Using an NC370D digital printer, manufactured by Fuji Photo Film Co., Ltd., an image was continuously printed on 500 sheets with printing temperatures in each of a low temperature range, a medium temperature range and a high temperature range. Then the thermal head of the printer was examined with an optical microscope. Soiling condition was evaluated in accordance with three levels, from A (good) to C (bad). Evaluation results are shown in table 1 below.

Head-Wearing Evaluation

Using an NC370D digital printer manufactured by Fuji Photo Film Co., Ltd., an image was continuously printed on 10,000 sheets with printing temperatures in each of a low temperature range, a medium temperature range and a high temperature range. Then a printing portion of the thermal head of the printer was measured with a laser-type surface contour measuring device. A degree of wearing was evaluated in accordance with three levels, from A (slight) to C (severe). Evaluation results are shown in table 1 below.

Homogeneity of Image Density

A large number of sheets were continuously printed. At 1,000-sheet intervals, a solid gray image was printed. A degree of printed image density unevenness, caused by head-soiling and head-wearing of the thermal head and the like, was evaluated therefrom in accordance with three levels, from A (slight) to C (severe). Evaluation results are shown in table 1 below.

TABLE 1

| | Heat-sensitive recording material | Head-soiling | Head-wearing | Image homogeneity |
|---|---|---|---|---|
| Example 1 | (1) | A | A | A |
| Example 2 | (2) | A | A | A |
| Comparative Example 1 | (3) | B | A | A/B |
| Comparative Example 2 | (4) | A | C | A/B |
| Comparative Example 3 | (5) | A | C | A/B |
| Comparative Example 4 | (6) | A | C | A/B |

From the results of table 1 it can be seen that heat-sensitive recording materials 1 and 2, which contained microparticle-aggregation particles in the outermost layer, namely, the protective layer, were excellent in both head-soiling and head-wearing, and could stably print uniform images with no unevenness of density. In contrast, heat-sensitive recording materials 3 to 6, which did not contain microparticle-aggregation particles in the outermost layer, could not avoid head-soiling and avoid head-wearing, and unevenness of density was discernible.

What is claimed is:

1. A heat-sensitive recording material having a heat-sensitive recording layer on a substrate, wherein the outermost layer on the side of the material having the heat-sensitive recording layer on the substrate contains microparticle-aggregation particles.

2. The heat-sensitive recording material of claim 1, wherein the microparticle-aggregation particles are composed of inorganic microparticles.

3. The heat-sensitive recording material of claim 2, wherein the inorganic microparticles are silica microparticles.

4. The heat-sensitive recording material of claim 3, wherein the outermost layer is a protective layer.

5. The heat-sensitive recording material of claim 3, wherein the microparticle-aggregation particles have a Mohs' hardness of from 2 to 8.

6. The heat-sensitive recording material of claim 3, wherein mean particle size of the microparticle-aggregation particles is from 0.5 to 10 μm.

7. The heat-sensitive recording material of claim 2, wherein the amount of the microparticle-aggregation particles in the outermost layer is from 0.01 to 1.0 g/m$^2$.

8. The heat-sensitive recording material of claim 2, wherein the outermost layer is a protective layer.

9. The heat-sensitive recording material of claim 2, wherein the microparticle-aggregation particles have a Mohs' hardness of from 2 to 8.

10. The heat-sensitive recording material of claim 2, wherein mean particle size of the microparticle-aggregation particles is from 0.5 to 10 μm.

11. The heat-sensitive recording material of claim 3, wherein the amount of the microparticle-aggregation particles in the outermost layer is from 0.01 to 1.0 g/m$^2$.

12. The heat-sensitive recording material of claim 1, wherein the outermost layer is a protective layer.

13. The heat-sensitive recording material of claim 12, wherein the amount of the microparticle-aggregation particles in the outermost layer is from 0.01 to 1.0 g/m$^2$.

14. The heat-sensitive recording material of claim 1, wherein the microparticle-aggregation particles have a Mohs' hardness of from 2 to 8.

15. The heat-sensitive recording material of claim 1, wherein mean particle size of the microparticle-aggregation particles is from 0.5 to 10 $\mu$m.

16. The heat-sensitive recording material of claim 1, wherein the amount of the microparticle-aggregation particles in the outermost layer is from 0.01 to 1.0 g/m$^2$.

* * * * *